US009011642B2

(12) United States Patent
Schmid et al.

(10) Patent No.: US 9,011,642 B2
(45) Date of Patent: Apr. 21, 2015

(54) SHEET FORMING UNIT FOR PRODUCING A MATERIAL WEB AND METHOD FOR OPERATING THE SHEET FORMING UNIT

(71) Applicant: Voith Patent GmbH, Heidenheim (DE)

(72) Inventors: Christian Schmid, Tettnang (DE); Ulrich Flühler, Schio (IT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/308,698

(22) Filed: Jun. 18, 2014

(65) Prior Publication Data

US 2014/0290885 A1 Oct. 2, 2014

Related U.S. Application Data

(60) Division of application No. 13/864,892, filed on Apr. 17, 2013, now Pat. No. 8,784,614, which is a continuation of application No. PCT/EP2011/066832, filed on Sep. 28, 2011.

(30) Foreign Application Priority Data

Oct. 19, 2010 (DE) ..... 10 2010 042 604

(51) Int. Cl.

| | |
|---|---|
| ***B31F 1/12*** | (2006.01) |
| ***D21F 1/40*** | (2006.01) |
| ***D21F 1/66*** | (2006.01) |
| ***D21F 9/00*** | (2006.01) |

(52) U.S. Cl.

CPC .. *D21F 1/40* (2013.01); *D21F 1/66* (2013.01); *D21F 9/003* (2013.01)

(58) Field of Classification Search

USPC ..... 162/111, 116, 141, 206, 214, 280, 290, 162/358.1, 303, 190, 264

See application file for complete search history.

(56) References Cited

U.S. PATENT DOCUMENTS 6,231,723 B1 5/2001 Kanitz et al.

FOREIGN PATENT DOCUMENTS

| | | | |
|---|---|---|---|
| DE | 10 2009 002 567 | A1 | 10/2010 |
| EP | 0 391 025 | A1 | 1/1990 |
| EP | 1 382 740 | A1 | 1/2004 |
| EP | 1 424 437 | A1 | 6/2004 |
| WO | 82/02910 | A1 | 9/1982 |

OTHER PUBLICATIONS

Notice of Transfer of International Research Report and the Written Notice issued for International Searching Authority or Statement for International Application No. PCT/EP2011/066832 dated Dec. 8, 2011 (12 pages).

EP 1 424 437, Lehner-Dittenberger, machine translation, Nov. 2002.

*Primary Examiner* — Mark Halpern

(74) *Attorney, Agent, or Firm* — Taylor IP, P.C.

(57) ABSTRACT

A sheet-forming unit of a papermaking machine includes a headbox which outputs a suspension jet and an inner fabric and an outer fabric, which in each case form a loop. A forming element is arranged within the loop of the inner fabric and guide rolls and a white-water box are arranged within the loop of the outer fabric. The inner fabric and the outer fabric form a gap for receiving the suspension jet and jointly wrap around the forming element at least partially in a wraparound region. A machine-wide guide element is arranged in the wraparound region within the loop of the outer fabric and/or, in the region of at least one of the guide rolls of the outer fabric, a machine-wide guide apparatus is provided outside the chamber which is formed by the loop of the outer fabric.

12 Claims, 2 Drawing Sheets

SHEET FORMING UNIT FOR PRODUCING A MATERIAL WEB AND METHOD FOR OPERATING THE SHEET FORMING UNIT

CROSS REFERENCE TO RELATED APPLICATIONS

This is a division of U.S. patent application Ser. No. 13/864,892, entitled "SHEET FORMING UNIT FOR PRODUCING A MATERIAL WEB AND METHOD FOR OPERATING THE SHEET FORMING UNIT", filed Apr. 17, 2013, which is incorporated herein by reference. U.S. patent application Ser. No. 13/864,892 is a continuation of PCT Application No. PCT/EP2011/066832, entitled "SHEET FORMING UNIT FOR PRODUCING A MATERIAL WEB, AND METHOD FOR OPERATING THE SHEET FORMING UNIT", filed Sep. 28, 2011, which is incorporated herein by reference.

BACKGROUND OF THE INVENTION

1. Field of the Invention

The present invention relates to a sheet forming unit of a paper machine, in particular a tissue machine for producing a fibrous web. The sheet forming unit includes a headbox which outputs a suspension jet and has an inner fabric and an outer fabric, which in each case forms a loop. A forming element is arranged within the loop of the inner fabric, and guide rolls and a white-water box for receiving the white water which accumulates in the region of the forming element are arranged within the loop of the outer fabric. The inner fabric and the outer fabric form a gap for receiving the suspension jet and jointly wrap around the forming element at least partially in a wraparound region. The present invention also relates to a method for operating a sheet forming unit.

2. Description of the Related Art

In generic sheet forming units in the current state of the art, solutions are known for efficient white water removal. Document WO 82/02910 describes solutions for twin wire sections as well as for twin wire sections with an upstream Fourdrinier wire section. The white water which is thrown off by the forming cylinder is directed over guide walls into a catch pan. In this process, the thrown off white water experiences only a slight loss in velocity, so that only small flow cross sections are necessary for removal of the white water. For this reason, mixing of this thrown off white water with other water components is avoided.

With ever increasing speeds, contamination due to water mists containing fines occur increasingly in known sheet forming units, especially in the region of the outer fabric. In order to avoid impairment of the production and quality of the produced paper web, the water mist is removed through pipe lines and hoods through active vacuum extraction by means of blowers. This solution is expensive in regard to the required equipment and energy consumption.

What is needed in the art is a cost effective solution for avoiding the disruptive effects of contamination in the region of the sheet forming unit.

SUMMARY OF THE INVENTION

The present invention provides a sheet forming unit of a paper machine, in particular a tissue machine for producing a fibrous web, having a headbox which outputs a suspension jet and having an inner fabric and an outer fabric which in each case form a loop. A forming element is arranged within the loop of the inner fabric, and guide rolls and a white-water box for receiving the white water which accumulates in the region of the forming element are arranged within the loop of the outer fabric. The inner fabric and the outer fabric form a gap for receiving the suspension jet and jointly wrap around the forming element at least partially in a wraparound region. The present invention distinguishes itself in that a machine-wide guide element is arranged in the wraparound region within the loop of the outer fabric in such a way that the white water is formed into a jet and is directed into the white water box in such a way that a contact surface is produced between the jet and the space which is formed by the loop of the outer fabric for receiving water mist and/or that, in the region of at least one of the guide rolls of the outer fabric, a machine-wide guide apparatus is provided outside the space which is formed by the loop of the outer fabric.

In this solution the use of existing kinetic energy from machine components or fluid jets, for example from fabrics, white water jets, and/or head box jets is useful in connection with the configuration and geometric arrangement of guide elements for the removal of water mist from the region of the outer fabric in a sheet forming unit. Thereby the water mist in the space inside the loop of the outer fabric, as well as the water mist which is carried along by the outside of the outer fabric can be discharged. The guide elements are, for example, manufactured from simple and cost effective sheet metals and are appropriately mounted. The expenditure for hoods and blowers is thereby greatly reduced or even eliminated.

The outer fabric and the inner fabric are for example arranged as forming fabrics. In an alternative configuration, the outer fabric is arranged as forming fabric, for example with zonally different permeability, whereas the inner fabric is a felt. The outer fabric may have a pattern to produce pictures and ornamentation in the fibrous web.

In an alternative design the outer fabric is arranged as forming fabric, for example with zonally different permeability, and the inner fabric is in the form of a textured fabric. Textured fabrics are known from the production of voluminous tissue papers, for example in so-called through-air drying machines. In this variation too, the outer fabric may have a pattern which is suitable to produce pictures or ornamentation in the fibrous web.

According to one embodiment of the present invention, the machine-wide guide element terminates before the white water box, when viewed in the direction of the jet flow. This produces a sufficiently long white water jet, which in turn allows for a sufficiently long contact surface to the space which is formed by the loop of the outer fabric, in order to suck off, pick up and discharge the water mist from this space by means of the propulsive jet effect.

The contact surface is located, for example, in direct contact with the space created by the loop of the outer fabric.

It is also conceivable that the guide element protrudes into the white water box only to the extent that the required contact surface for sucking-off of the water mist from the space created by the loop of the outer fabric is ensured. The length of the white water box—viewed transversely to the machine width—is hereby only long enough so that the water mists are sucked from the space formed by the loop of the outer fabric.

In a practical situation the length of the opening of the white water box is less than approximately 1 meter (m), for example less than 0.6 m. The water mist which is picked up by the white water jet is thereby prevented from returning into the space created by the loop of the outer fabric due to creation of a vortex.

The length of the contact surface—viewed in the direction of travel or flow of the jet—is, for example, more than 100 millimeters (mm), for example more than 150 mm, or more than 200 mm.

According to a further embodiment of the present invention, the guide element is configured so that the created white water jet is not substantially redirected.

The forming element may have an open surface in order to promote dewatering of the fibrous web. In some cases the forming element may be equipped with suction. In a further embodiment of the present invention, the forming element is in the embodiment of a roll.

Advantageously, a gap is created between the guide element and the forming element. The white water emerging from the outer fabric collects in this gap and flows along the guide element in the direction of the white water box.

In another embodiment of the present invention the progression of the guide element substantially follows the contour of the forming element.

According to a further embodiment of the present invention, the progression of the guide element is selected so that the gap—viewed in the direction of travel of the outer fabric—exhibits a divergent progression. This avoids a reverberation of the white water upon the outer fabric of the white water volume which increases in the direction of travel of the fabrics, thereby preventing breakdown of the quality of the fibrous web.

In a further embodiment of the present invention, the progression of the guide element is selected so that the initial distance to the forming element at the beginning of the gap is between approximately 10 mm and 60 mm, for example between 20 and 40 mm, thereby achieving a proficient collection effect in regard to the emerging white water. The divergence of the gap progresses from the initial distance to a distance greater than 30 mm, for example greater than 40 mm, or greater than 50 mm after a distance which is consistent with an angle of approximately 90° of the wraparound region.

The beginning of the guide element is arranged so that the white water of the head box jet penetrating through the outer fabric is captured. The start of the guide element is essentially arranged on the assumed extension of the headbox jet.

In another embodiment of the present invention, the white water box is equipped with deflector devices for lateral deflection of the admitted white water and the carried along water mist. The lateral deflection occurs transversely to the direction of movement of the paper machine, preferably the drive side. The deflector devices consist of bent or of beveled sheet metals.

According to one embodiment of the present invention, two adjacent deflector devices always form a channel—that is a flow channel for the white water, whereby the distance between the deflector devices is so small that the formation of vortexes extending into the space formed by the loop of the outer fabric is avoided. The deflector devices moreover have surfaces tilted by one deflection angle relative to each other, whereby the angle of deflection viewed in a flow direction between adjacent surfaces is less than 20°. Vortexes and backflows are thereby avoided.

In another embodiment of the present invention, the at least one guide apparatus, arranged in the region of the guide rolls of the outer fabric outside the space which is formed by the loop of the outside fabric, forms a converging gap with the outer fabric, viewed in the direction of movement. The boundary layer of water mist carried along by the outer fabric is thereby captured in the region of the curvature of the outer fabric and directed back to the outer fabric in the form of a water layer and subsequently discharged in a controlled manner, for example through the headbox jet.

It is thereby advantageous if the gap has an initial height of less than approximately 150 mm, for example less than 100 mm, or less than 80 mm and a final height of less than approximately 50 mm, for example less than 30 mm, or less than 10 mm.

A guide apparatus is advantageously allocated to the guide roll adjacent to the headbox in such a way that the space formed by the guide apparatus and the outer fabric can be supplied with suction through the propulsive jet effect of the suspension jet. The water mist accumulating in this apace is thereby removed through the head box jet into the white water box.

The present invention can be employed at fabric speeds of higher than 1400 meters per minute (m/min), for example higher than 1500 m/min, or higher than 1600 m/min.

The present invention further provides a method for operating a sheet forming unit of a paper machine, in particular a tissue machine for producing a fibrous web. The sheet forming unit includes a headbox which outputs a suspension jet and has an inner fabric and an outer fabric, which in each case form a loop. A forming element is arranged within the loop of the inner fabric, and guide rolls and a white-water box for receiving the white water which accumulates in the region of the forming element are arranged within the loop of the outer fabric. The inner fabric and the outer fabric form a gap for receiving the suspension jet and jointly wrap around the forming element at least partially in a wraparound region. According to the present invention the solution exists in that the kinetic energy of the suspension jet and/or of the thrown off white water and/or the outer fabric is used for controlled discharge of water mist.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention and such exemplifications are not to be construed as limiting the scope of the invention in any manner.

DETAILED DESCRIPTION OF THE INVENTION

Figure 1:
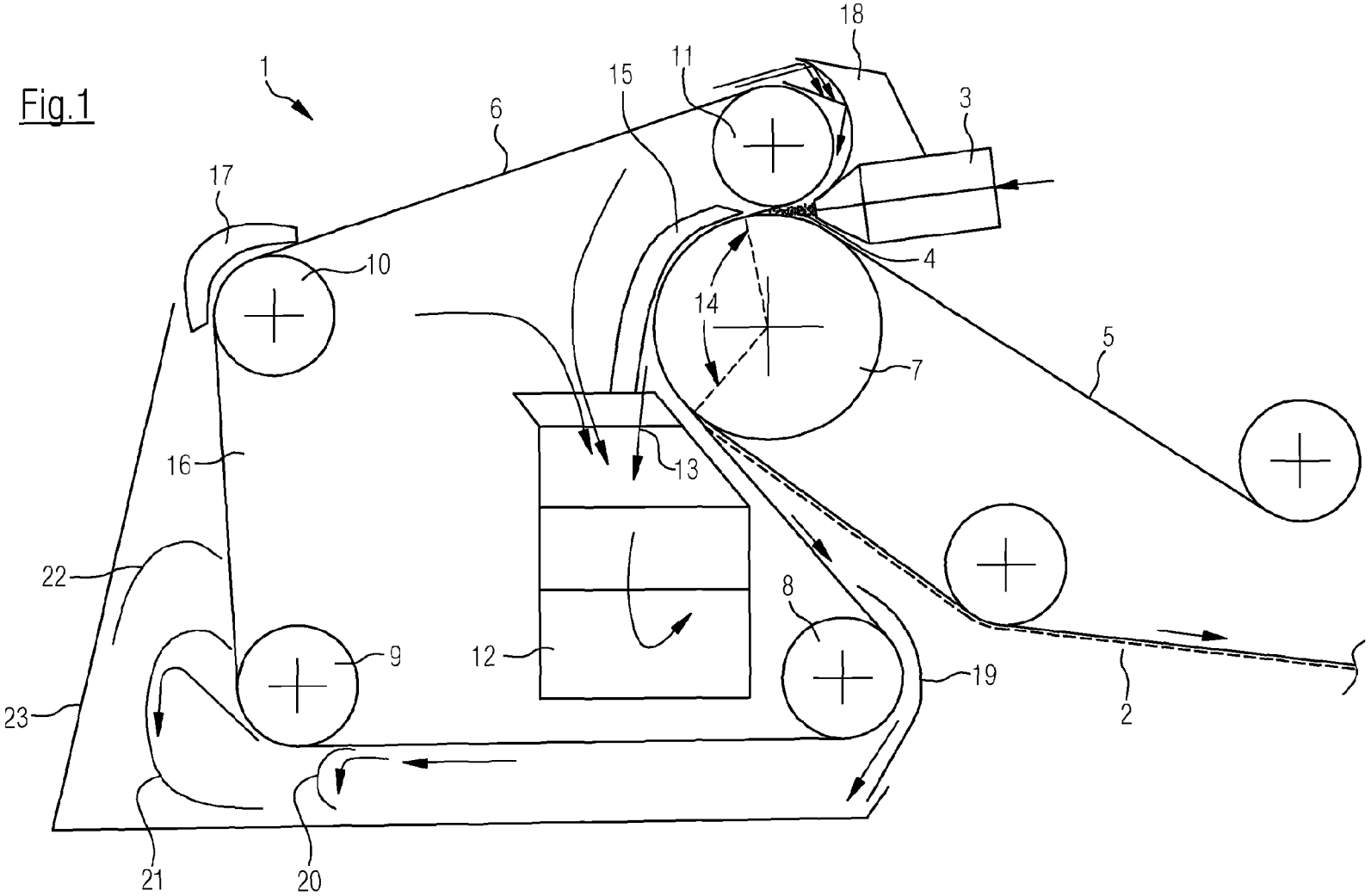
FIG. 1 is a schematic illustration of a longitudinal sectional view of one embodiment of a sheet forming unit according to the present invention.

Referring now to the drawings, and more particularly to FIG. 1, there is shown a longitudinal sectional view of one embodiment of a sheet forming unit 1 in a tissue machine. Inner fabric 5 wraps around forming element 7 which is in the embodiment of a forming roll and carries the formed fibrous web 2 to a transfer location for the transfer of fibrous web 2 onto a downstream clothing or directly to the subsequent process segment which is not illustrated here. This may include alternatively a free standing single press or a combination of a press consisting of a press roll and a drying cylinder, a drying, creping and winding unit. Outer fabric 6, jointly with inner fabric 5, wraps around forming roll 7 in wraparound region 14. This is, for example, greater than 90°. Inner fabric 5 and outer fabric 6 form an inlet gap to receive suspension jet 4 being delivered from headbox 3. The suspension is being dewatered in the region of forming roll 7, and fibrous web 2 is formed. Dewatering occurs primarily by means of outer fabric 6. White water 13 which is emerging tangentially through outer fabric 6, is captured by guide element 15 and redirected so that white water jet 13 is created. The start of guide element 15 is located in the region of an assumed extension of headbox jet 4, so that also white water 13 which is carried along by outer fabric 6 is captured.

The initial distance of guide element 15 to the inside of outer fabric 6 at the beginning of guide element 15 is 30 mm in this example. In further progression of the guide element the distance after some distance which is consistent with an angle of 90° of the wraparound region increases to 45 mm, so that a divergent gap exists. After that, the curvature of the guide element decreases, due to which the divergence increases further. Viewed in a flow direction of the white water, white water box 12 is located after guide element 15 into which white water jet 13 flows. It is essential hereby that guide element 15 does not dip too deeply into white water box 12, but that instead an open jet length of white water jet 13 is assured, in order to produce a sufficient contact surface of at least one side of white water jet 13 to space 16 which is created by the loop of the outer fabric. In this example, the contact surface is greater than 150 mm. This contact surface produces a suction effect according to the propulsion jet principle, whereby the water mist is drawn off in space 16 and is discharged together with white water 13 via white water box 12. Compared with the current state of the art, expensive pipe lines, hoods and blowers can therefore be eliminated for water mist removal. The cross section of the white water tank for accommodation of white water 13 is calculated such, that no vortex formation is possible. In this practical example the length of the opening of white water box 12 is, for example less than 0.6 m. The water mist which is picked up by the white water jet is thereby prevented from returning into the space which is formed by the loop of the outer fabric, due to vortex formation. Inside white water box 12, the picked up white water 13 with water mist is deflected, for example to the drive side and discharged. The deflection occurs by means of deflector devices 24 which are installed in white water box 12. Adjacently located deflector devices 24 respectively form a flow channel. Outer fabric 6 is separated from inner fabric 5 after forming element 7, whereby formed fibrous web 2 is transported away together with inner fabric 5.

Outer fabric 6 is returned again to forming element 7 via guide rolls 8, 9, 10, 11. Below the loop of outside fabric 6 and on the side facing away from the forming element, save-all pan 23 is provided to capture the white water and water mist which is carried along in the texture of outer fabric 6 and on its surface. Save-all pan 23 surrounds the lower part of the loop of outside fabric 6, thereby encapsulating this part. The liquid which is carried along on the fabric surface is stripped off at low vortexes, deflected and delivered to save-all pan 23 by curved guide devices 19, 20, 21, 22. Guiding apparatuses 17, 18 are arranged in the region of guide rolls 10, 11, outside the space formed by the loop of outer fabric 6. The guide apparatuses 17, 18 form a converging gap with outer fabric 6 in the direction of movement. The boundary layer of water mist carried along by outer fabric 6 is thereby captured in the region of the curvature of outer fabric 6 and directed back to outer fabric 6 in the form of a water layer and subsequently discharged in a controlled manner, for example through headbox jet 4. The gap has an initial height of less than 100 mm and a final height of less than 30 mm. Before headbox 3, suction is applied to the gap through headbox jet 4 according to the propulsion jet principle, thereby discharging the water mist which is carried along by outer fabric 6 through the forming section into white water box 12. Forming roll 7 features an enclosed shell. Dewatering therefore occurs exclusively through the outer fabric.

Figure 2:
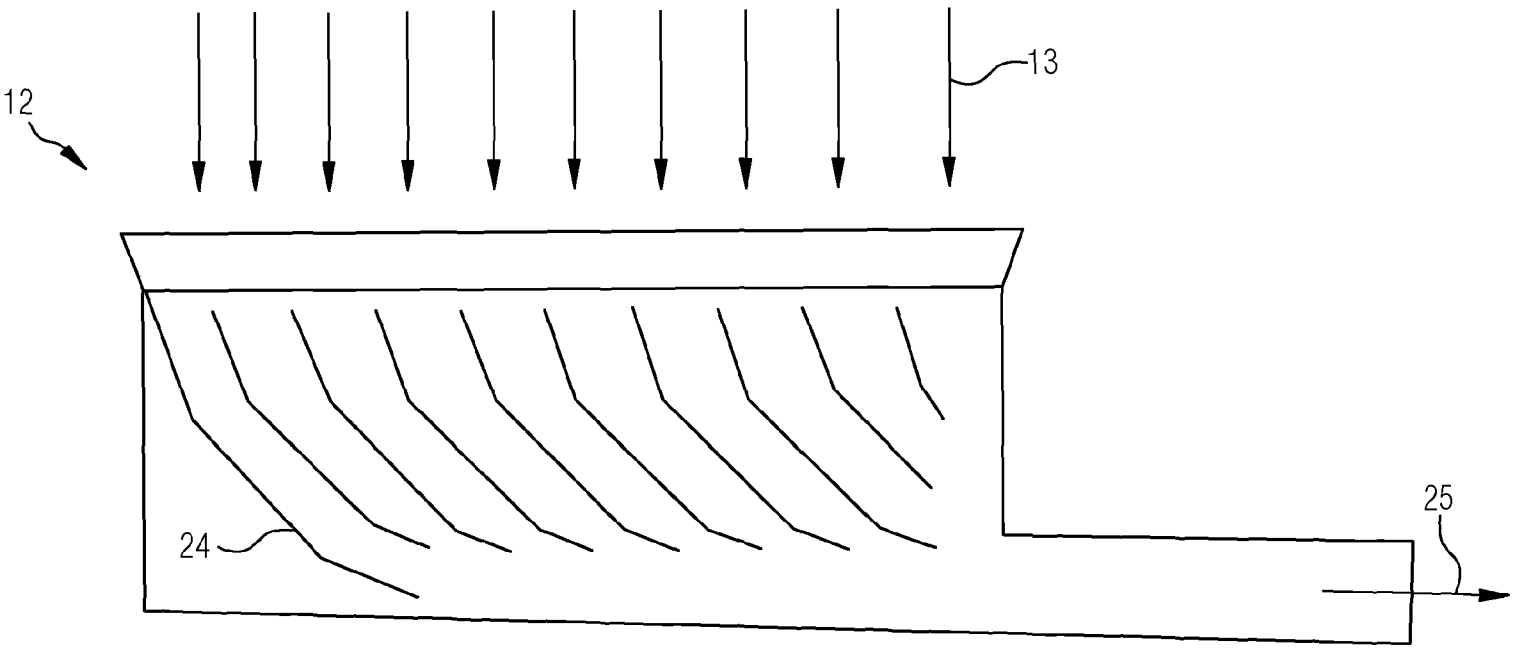
FIG. 2 is a schematic illustration of a cross section of the white water box in illustrated in FIG. 1.

Referring now to FIG. 2, there is shown a schematic illustration of a cross section of white water box 12 in FIG. 1. White water box 12 is configured to be machine wide. White water jet 13 flows from above into the opening of white water box 12. Deflector devices 24 are provided therein, whereby two adjacently located deflector devices 24 form a channel, that is a flow channel for white water 13, whereby the distance between the deflector devices is so small that the formation of flow turbulences extending into the space formed by the loop of the outer fabric is avoided.

The deflector devices moreover have surfaces tilted by one deflection angle relative to each other, whereby the angle of deflection viewed in the flow direction between adjacent surfaces is less than 20°. Vortexes and backflows are thereby avoided. The white water is recycled into the production process on the drive side of the paper machine, through lateral white water discharge 25. Lateral white water discharge 25 may be equipped with suction, either directly through a vacuum device or through a drop leg. This allows the discharge performance to be adapted to the white water volume.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1 Sheet forming unit
2 Fibrous web
3 Headbox
4 Suspension jet
5 Inner fabric
6 Outer fabric
7 Forming unit
8 Guide roll
9 Guide roll
10 Guide roll
11 Guide roll
12 White water box
13 Whitewater, white water jet
14 Wraparound region
15 Guide element
16 Space outer fabric
17 Guide apparatus
18 Guide apparatus
19 Guide apparatus
20 Guide apparatus
21 Guide apparatus
22 Guide apparatus
23 Save-all pan
24 Deflector device
25 Lateral white water discharge
26 Water mist

What is claimed is:

1. A method of operating a sheet forming unit of a paper machine, the method comprising the steps of:

providing a headbox for outputting a suspension jet;

providing an inner fabric and an outer fabric;

forming said inner fabric into an inner fabric loop and said outer fabric into an outer fabric loop;

arranging a forming element within said inner fabric loop;

arranging a plurality of guide rolls and a white-water box for receiving white water which accumulates in a region of said forming element in said outer fabric loop;

forming a gap between said inner fabric and said outer fabric for receiving said suspension jet;

jointly wrapping said inner fabric and said outer fabric around said forming element at least partially in a wrap-around region;

providing a machine-wide guide element having a portion generally concentric with said forming element and a portion being increasingly divergent from said forming element in a direction of travel, said machine-wide guide element being positioned in said wraparound region within said outer fabric loop such that white water is formed into a white-water jet and is directed into said white water box such that a contact surface is formed between said white-water jet and a space formed by said outer fabric loop, wherein a gap is formed between said machine-wide guide element and said forming element; and using at least one of a kinetic energy of said suspension jet and said white-water jet for controlled discharge of water mist.

2. The method according to claim 1, wherein said sheet forming unit is for a tissue machine for producing a fibrous material web.

3. The method according to claim 1, further comprising the step of providing at least one machine-wide guide apparatus which is:

located in a region of at least one of said plurality of guide rolls of said outer fabric and outside said space formed by said outer fabric loop, said machine-wide guide apparatus being generally concentric with said at least one of said plurality of guide rolls and forming a converging gap with said outer fabric in a direction of movement.

4. The method according to claim 1, said forming element being a roll.

5. The method according to claim 1, further comprising the step of selecting a progression of said machine-wide guide element such that a distance to said forming element at a beginning of said gap is between approximately 10 millimeters (mm) and 60 mm.

6. The method according to claim 5, wherein said distance is between approximately 20 mm and 40 mm.

7. The method according to claim 1, further comprising the step of providing said white-water box with a plurality of deflector devices for laterally deflecting white-water and water mist.

8. The method according to claim 7, wherein two adjacent said deflector devices always form a channel, wherein a distance between said adjacent deflector device is so small that a formation of a vortex extending into said space formed by said outer fabric loop is avoided.

9. The method according to claim 8, further comprising the step of tilting said plurality of deflection devices such that a surface of each said deflection device has a deflection angle relative to other said deflection devices, said angle of deflection viewed in a flow direction between adjacent said surfaces being less than approximately 20 degrees.

10. The method according to claim 3, further comprising the step of allocating a machine-wide guide apparatus to a guide roll adjacent to said headbox such that a space is formed by said machine-wide guide apparatus.

11. The method according to claim 10, further comprising the step of configuring said outer fabric to be supplied with suction through a propulsive jet effect of said suspension jet.

12. The method according to claim 1, wherein the length of said contact surface viewed in a direction of travel is greater than 100 millimeters (mm).

* * * * *